US010071014B2

(12) United States Patent
Yeh

(10) Patent No.: US 10,071,014 B2
(45) Date of Patent: Sep. 11, 2018

(54) MASSAGE ROLLER

(71) Applicant: Tzong In Yeh, Fremont, CA (US)

(72) Inventor: Tzong In Yeh, Fremont, CA (US)

(73) Assignee: AGIT Global IP Holdings, LLC, Irvine, CA (US)

( * ) Notice: Subject to any disclaimer, the term of this patent is extended or adjusted under 35 U.S.C. 154(b) by 396 days.

(21) Appl. No.: 14/830,065

(22) Filed: Aug. 19, 2015

(65) Prior Publication Data

US 2016/0235619 A1 Aug. 18, 2016

(30) Foreign Application Priority Data

Feb. 13, 2015 (TW) ..... 104105140 A

(51) Int. Cl.
*A61H 15/00* (2006.01)

(52) U.S. Cl.
CPC ..... *A61H 15/00* (2013.01); *A61H 2015/0014* (2013.01); *A61H 2201/1284* (2013.01); *A61H 2201/169* (2013.01); *A61H 2201/1685* (2013.01)

(58) Field of Classification Search
CPC ..... A61H 15/00; A61H 2201/1685; A61H 2201/1284; A61H 2015/0014; A61H 2201/169
See application file for complete search history.

(56) References Cited

U.S. PATENT DOCUMENTS

| | | | | |
|---|---|---|---|---|
| 6,419,650 | B1 * | 7/2002 | Ryan | A61H 15/00 601/122 |
| 8,926,482 | B2 * | 1/2015 | Miller, Jr. | A63B 22/20 482/132 |
| 9,132,055 | B1 * | 9/2015 | Wallace | A61H 23/0263 |
| 9,168,411 | B2 * | 10/2015 | Holman | A63B 21/028 |
| 2012/0065557 | A1 * | 3/2012 | Phillips | A61H 15/0092 601/99 |
| 2015/0005146 | A1 * | 1/2015 | Chen | A63B 21/00047 482/142 |
| 2015/0045707 | A1 * | 2/2015 | Selvaggio | A61H 15/0092 601/118 |
| 2015/0257969 | A1 * | 9/2015 | Shannon | A61H 15/00 601/121 |

* cited by examiner

*Primary Examiner* — Sundhara Ganesan
(74) *Attorney, Agent, or Firm* — Muncy, Geissler, Olds & Lowe, P.C.

(57) ABSTRACT

The present invention provides a massage roller which comprises a soft shell, a core member, a first blocking member and a second blocking member. The core member is substantially cylindrical and hollow and made of a rigid material. The soft shell is disposed around the core member and made of a flexible material. The first blocking member blocks a front end of the soft shell and has a first extension detachably secured to a front end of the core member. The second blocking member is secured to a rear end of the core member and blocks a rear end of the soft shell. The soft shell and the core member are configured to be axially displaceable relative to each other but not rotatable relative to each other.

4 Claims, 6 Drawing Sheets

MASSAGE ROLLER

BACKGROUND OF THE INVENTION (1) Field of the Invention

The present invention relates to a massage roller for exercise or fitness, and more particularly to a massage roller having an interchangeable shell.

(2) Description of the Prior Art

A conventional massage roller (also known as a yoga roller or a foam roller) is adapted for exercise or fitness. Generally, the massage roller is composed of a rigid core member and a soft shell which is softer than the core member. The core member is usually made of non-expanded plastic. The soft shell is usually made of foam material such as expanded polyethylene or expanded polypropylene. Commonly, the soft shell is deposed around the outer surface of the core member; the soft shell and the core member are adhered to each other via a cohesive agent so that the soft shell would not be detached from the core member or rotate relative to the core member.

As shown in FIG. 8, another conventional detachable yoga rod structure comprises a yoga rod 51 and an outer sleeve 52. The outer sleeve 52 is merely sleeved on a smooth surface 511 of the yoga rod 51 but is not adhered to the yoga rod 51 or secured on the yoga rod 51. Thus, when a user presses on the yoga rod structure5, the outer sleeve 52 is possible to rotate relative to the yoga rod 51 and further be separated from the yoga rod 51.

SUMMARY OF THE INVENTION

To solve the aforementioned problems, an exemplary embodiment of the invention provides a massage roller, comprising a core member and a replaceable soft shell mounted around the core member.

Specifically, the massage roller comprises the soft shell, the core member, a first blocking member and a second blocking member. The core member is substantially cylindrical and hollow and made of a rigid material. The soft shell is disposed around the core member and made of a flexible material. The first blocking member blocks a front end of the soft shell and has a first extension detachably secured to a front end of the core member. The second blocking member is secured to a rear end of the core member and blocks a rear end of the soft shell. The soft shell and the core member are configured to be axially displaceable relative to each other but not rotatable relative to each other.

Preferably, the soft shell has a plurality of grooves arranged at an interval in an inner surface thereof; and each of the grooves extends from front to rear of the soft shell and is parallel to one another. And, the core member has a plurality of rails arranged at an interval on an outer surface thereof; and the rails of the core member are engaged in the respective grooves of the soft shell so that the core member and the soft shell are prevented from rotation relative to each other.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1:
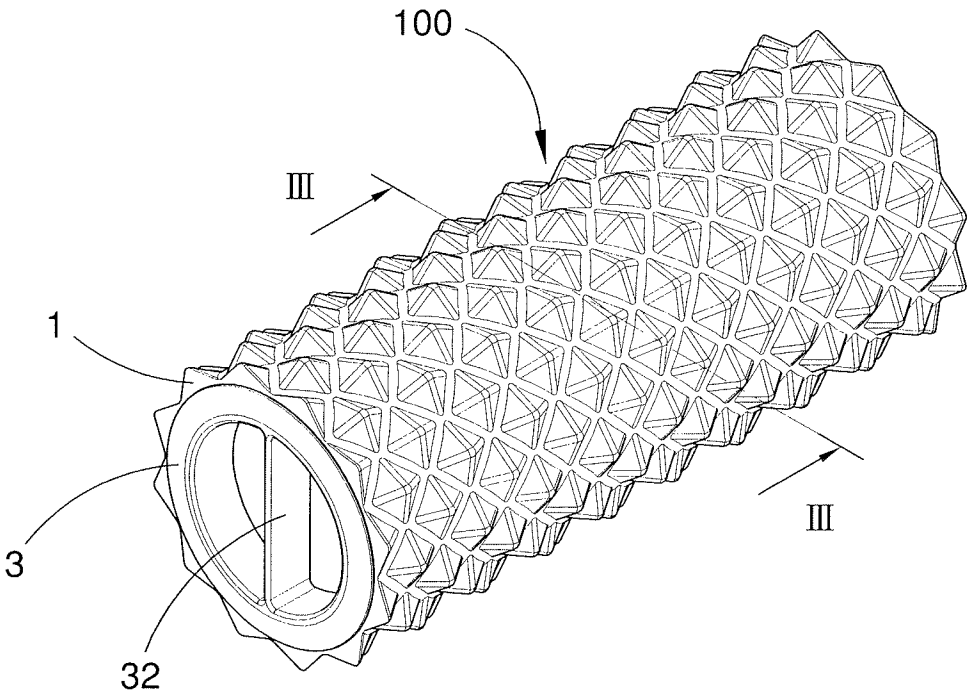
FIG. 1 is a perspective view of a massage roller according to a first embodiment of the present invention.
Figure 2:
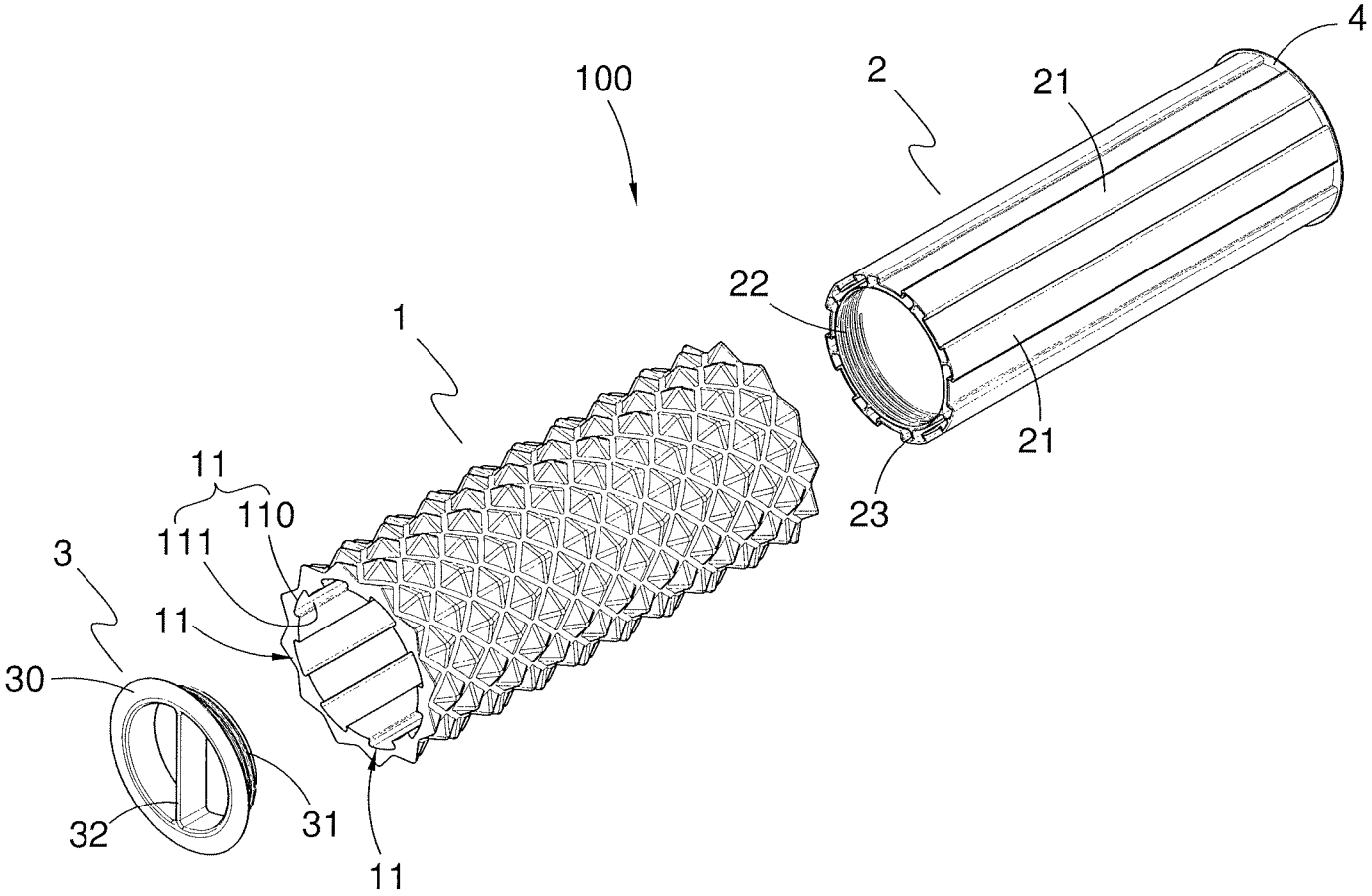
FIG. 2 is an exploded perspective view of the massage roller shown in FIG. 1.

FIGS. 1 to 5 show a massage roller 100 according to a first embodiment of this invention. As shown in FIGS. 1 and 2, the massage roller 100 comprises a soft shell 1, a core member 2, a first blocking member 3 and a second blocking member 4.

The core member 2 has a predetermined length and is substantially cylindrical and hollow. Moreover, the core member 2 is made of a rigid material which is tough and pressure-resistant. The core member 2 preferably is made of non-expanded plastic. Alternatively, the core member 2 may be made of a metal material, for example, by aluminum extrusion.

The soft shell 1 preferably has a predetermined length and is disposed around the core member 2. The soft shell 1 is made of a soft and flexible material, such as expanded polyethylene, expanded polypropylene, expanded polystyrene, ethylene vinyl acetate, rubber, or other expanded material. Preferably, ethylene vinyl acetate is selected. The soft shell 1 may be formed by injection molding or from a sheet by rolling and bonding.

Preferably, a plastic film (not shown) may be adhered to an outer surface of the soft shell 1 with an adhesive agent. The plastic film may be made of Surlyn® resin, also known as an ionomeric ethylene copolymer. More preferably, a pattern may be printed on a bottom surface of the plastic film.

Figure 4:
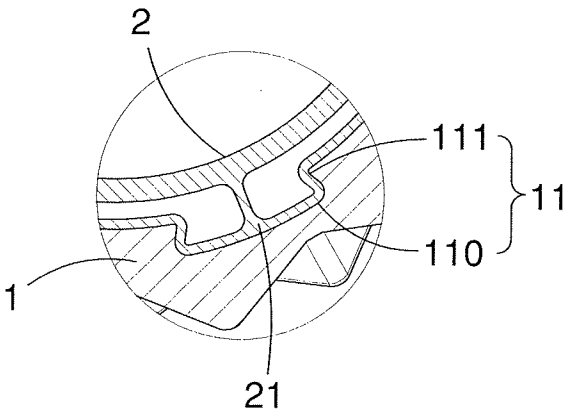
FIG. 4 is a partial enlarged view of the massage roller shown in FIG. 3.
Figure 3:
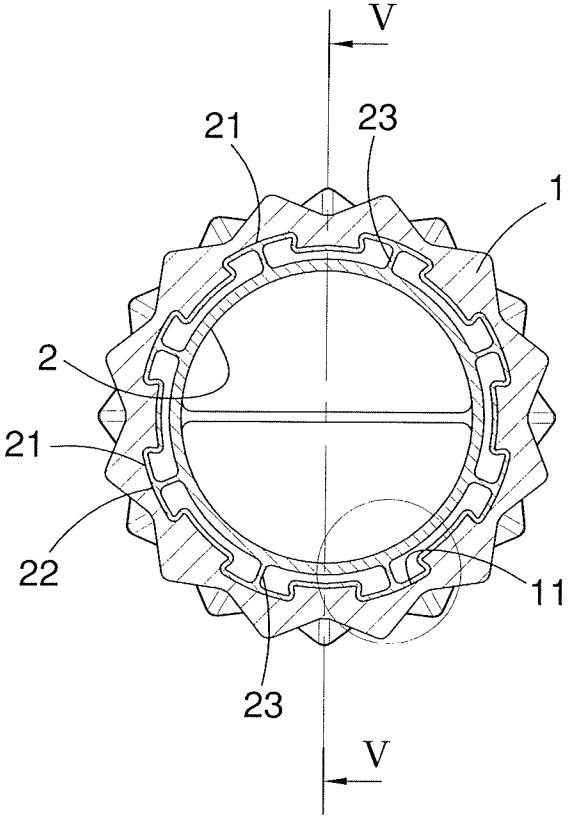
FIG. 3 is a cross-sectional view of the massage roller taken along the line III-III in FIG. 1.

For different purposes in exercise, the outer surface of the soft shell 1 may be planar or rugged. In this embodiment, the soft shell 1 has a rugged outer surface with bumps thereon to provide a massage function for the user. As shown in FIGS. 2 to 4, the soft shell 1 has a plurality of grooves 11 arranged at an interval on an inner surface thereof. Each of the grooves 11 extends from front to rear of the soft shell 1 and is parallel to one another. On the other hand, the core member 2 has a plurality of rails 21 arranged at an interval on an outer surface thereof. Each of the rails 21 of the core member 2 are engaged within the respective groove 11 of the soft shell 1 so that the core member 2 and the soft shell 1 are prevented from rotation relative to each other, as depicted in FIG. 3. That is, while in use, the soft shell 1 can be pulled out of the core member 2 but is prevented from rotation relative to the core member 2.

In this embodiment, as best shown in FIG. 4, each of the grooves 11 is in a shape of a dovetail, and has a bottom 110 and an opening 111 which has a width smaller than that of the bottom 110. The shape of the grooves 11 is not limited to this embodiment but is permitted to select a shape which achieves the function of preventing the soft shell 1 from rotation relative to the core member 2.

Figure 5:
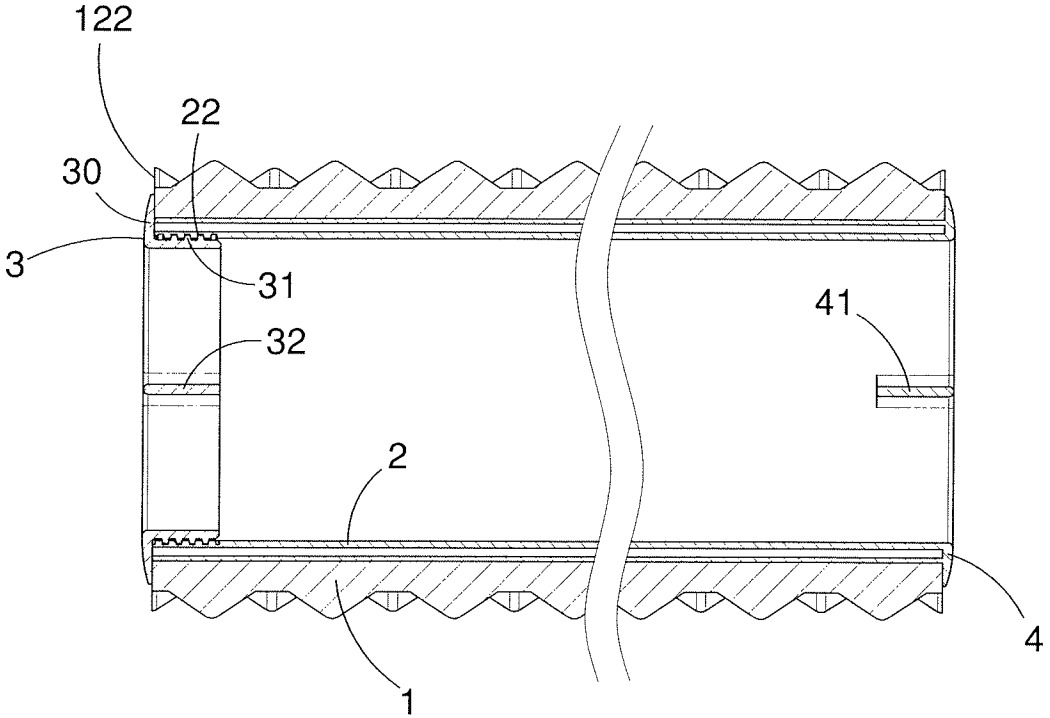
FIG. 5 is another cross-sectional view of the massage roller taken along the line V-V in FIG. 3.

The first blocking member 3 and the second blocking member 4 may be made of the same material as the core member 2. As shown in FIG. 5, the first blocking member 3 abuts and blocks against a front end of the soft shell 1. The second blocking member 4 abuts and blocks against a rear end of the soft shell 1. Thereby, the soft shell 1 and the core member 2 are prevented from being axially displaceable relative to each other.

In this embodiment, the first blocking member 3 is screwed with the core member 2 while the second blocking member 4 is formed integrally from the core member 2. Thus, the first blocking member 3 and the core member 2 are detachable from each other while the second blocking member 4 cannot be detached from the core member 2. When the first blocking member 3 is detached from the core member 2, the soft shell 1 is permitted to be pulled out of the core member 2. A user can then replace the soft shell 1 with another soft shell (not shown).

As shown in FIGS. 2 and 5, an inner threaded section 22 is provided on an inner wall of a front end of the core member 2. The first blocking member 3 serves as a lid and includes a first flange portion 30 and a first extension 31. The first extension 31 has an outer threaded section (not numbered) corresponding to the inner threaded section 22 of the core member 2. When the outer thread section of the first extension 31 of the first blocking member 3 is engaged with the inner threaded section 22 of the core member 2, the first flange 30 abuts and blocks against the front end of the soft shell 1.

Alternatively, in other examples, an outer threaded section may be provided on an outer wall of the front end of the core member 2, and the first threaded extension 31 of the first blocking member 3 has an inner threaded section corresponding to the outer threaded section of the core member 2 for engagement of the first blocking member 3 with the core member 2. While it is preferable that the first blocking member 3 and the core member 2 are engaged by screwing, those of skill in the art will appreciate from this disclosure that other means may be selected, such as press fitting.

In addition, a partition 32 may be provided and bridged within a center recess of the first blocking ring 30 for gripping the first blocking member 3. The second blocking member 4 is formed integrally from a rear end of the core member 2 for blocking the rear end of the shell 1. Similarly, the second blocking member 4 has a partition 41 bridged within a center recess of the second blocking member 4 for gripping. Alternatively, in other examples, the second blocking member 4 may be configured to be detachable from the core member 1.

Besides, as shown in FIGS. 1 and 3, the core member 2 is configured to be hollowing out to reduce the weight of the core member 2. And the core member 2 further has a plurality of ribs 23 to strengthen the structure of the core member 2.

Figure 6:
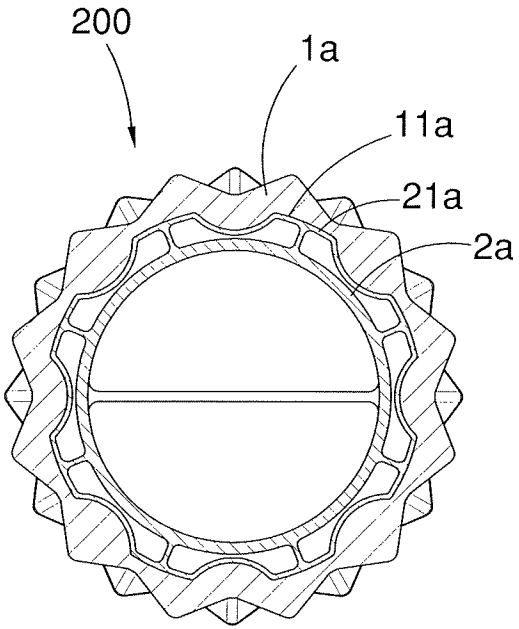
FIG. 6 is a cross-sectional view of a second embodiment of the present invention.
Figure 8:
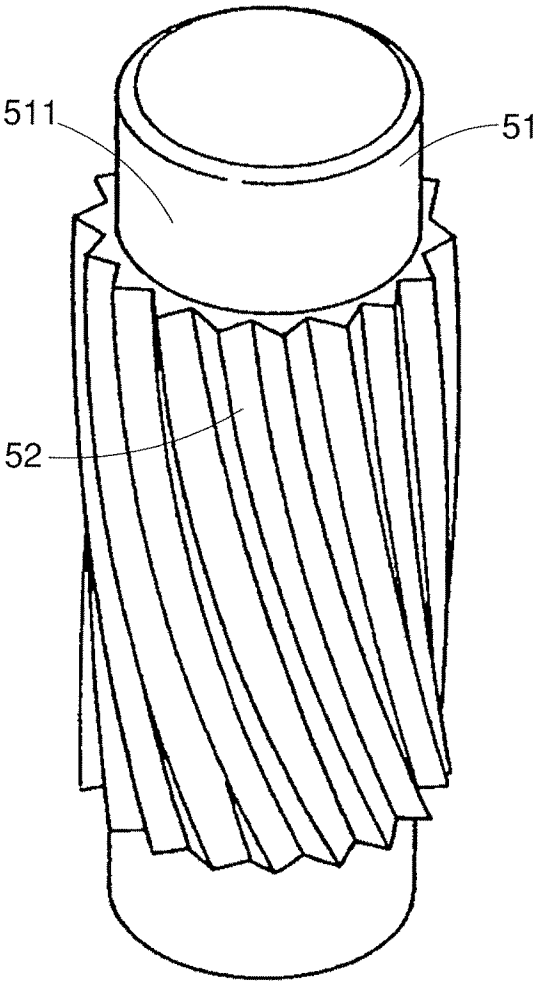
FIG. 8(Prior Art)
FIG. 8 is a perspective view of a conventional yoga rod structure.

FIG. 6 shows a massage roller 200 according to a second embodiment of this invention. The function and structure of the massage roller 200 in this second embodiment are substantially similar to the massage roller 100 of the first embodiment shown in FIGS. 1-5, except that the grooves 11*a* of the soft shell 1*a* are arc-shaped. The core member 2*a* is complementary in shape to the grooves 11*a* of the soft shell 1*a*.

Figure 7:
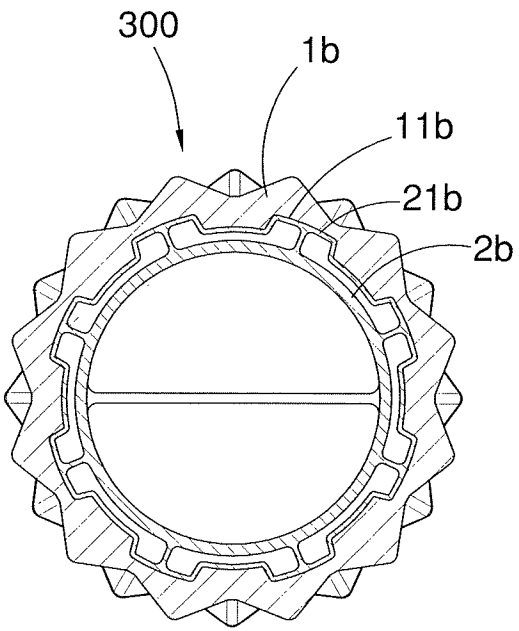
FIG. 7 is a cross-sectional view of a third embodiment of the present invention.

FIG. 7 shows a massage roller 300 according to a third embodiment of this invention. The function and structure of the massage roller 300 in this third embodiment are substantially similar to the massage roller 100 of the first embodiment shown in FIGS. 1-5, except that the shape of the grooves 11*b* of the soft shell 1*b* and the shape of the rails 21*b* of the core member 2*b* are trapezoidal.

As described above, the massage roller of this invention not only provides a replaceable soft shell 1 but also have the soft shell 1 and the core member 2 of the massage roller firmly combined. When a user presses on the massage roller, the soft shell 1 and the core member 2 are prevented from axially displacing or rotating relative to each other.

It will be apparent that various modifications may be made to the above specifically described structural arrangements without departing from the scope of the invention.

What is claimed is:

1. A massage roller, comprising:

a core member, being substantially cylindrical and hollow, made of a rigid material, and having two or more rails arranged on an outer surface thereof;

a soft shell disposed around the core member, made of a flexible material, and having two or more parallel grooves arranged in an inner surface thereof, and each groove extending from front to rear of the soft shell for engagement with a respective one of the rails of the core member to prevent the soft shell from rotation with respect to the core member;

a closed end cap formed in one piece and detachably secured to a front end of the core member, the closed end cap having a body for closing the front end of the core member, an axial extension for connection with the front end of the core member, and a flange portion for abutting against an end surface of a first end of the soft shell when the axial extension is engaged with the front end of the core member; and a blocking member secured to a rear end of the core member, and having a body for closing the rear end of the core member and a flange portion for abutting against an end surface of a rear end of the soft shell; wherein the flange portions of the closed end cap and the blocking member work together to confine axial movement of the soft shell with respect to the core member.

2. A massage roller of claim 1, wherein each of the grooves of the soft shell is in a shape of a dovetail.

3. A massage roller of claim 1, wherein the axial extension of the closed end cap has external threads, and the front end of the core member has internal threads so that the axial extension of the closed end cap is mated with and detachably attached to the front end of the core member.

4. A massage roller of claim 1, wherein the axial extension of the closed end cap is pressed fit in the core member.

* * * * *